US005315835A

United States Patent [19]

Park

[11] Patent Number: 5,315,835

[45] Date of Patent: May 31, 1994

[54] METHOD OF LEARNING A REFRIGERATOR USE PATTERN FOR CONTROLLING A DEFROSTING OPERATION OF THE REFRIGERATOR

[75] Inventor: Seong S. Park, Kyungsangnam-Do, Rep. of Korea

[73] Assignee: Goldstar Co., Ltd., Seoul, Rep. of Korea

[21] Appl. No.: 993,609

[22] Filed: Dec. 21, 1992

[30] Foreign Application Priority Data

Dec. 21, 1991 [KR] Rep. of Korea ..... 23804/1991

[51] Int. Cl.[5] ..... F25D 21/06; F25B 47/02

[52] U.S. Cl. ..... 62/80; 62/153; 62/155

[58] Field of Search ..... 62/80, 131, 151, 153, 62/155, 234

[56] References Cited

U.S. PATENT DOCUMENTS 4,297,852 11/1981 Brooks ..... 62/153

4,528,821 7/1985 Tershak et al. ..... 62/153

*Primary Examiner*—Harry B. Tanner

[57] ABSTRACT

A method for controlling a defrosting operation of a refrigerator by providing a defrosting operation control method wherein a refrigerator use pattern by the user is learned. The defrosting operation control method based on the learning of the refrigerator use pattern comprises the steps of dividing a day, namely, 24 hours into a plurality of time intervals each corresponding to a predetermined period, for example, one hour, calculating the number of refrigerator door openings by time intervals, repeating the calculating step for predetermined days, storing information about arithmetic average values of the number of door openings calculated by time intervals, and performing a defrosting operation during the period that the refrigerator is not used by the user, based on the arithmetic average value information. The overall steps are also periodically repeated after the lapse of predetermined days so that a variation in refrigerator using pattern by the user can be learned, so as to control the defrosting operation based on the variation.

12 Claims, 6 Drawing Sheets

* T1 T2 T3 : FREQUENT USE PERIODS OF REFRIGERATOR
* t1: TIME POINT WHEN COMPRESSOR IS FORCIBLY TURNED OFF
* t2: TIME POINT WHEN CHAMBER TEMPERATURE EXCEEDS THE MAXIMUM TEMPERATURE
* t3: TIME POINT WHEN CHAMBER TEMPERATURE REACHES THE MAXIMUM TEMPERATURE
* T4: PERIOD THAT CHAMBER TEMPERATURE EXCEEDS THE MAXIMUM TEMPERATURE

| | memory address | $M(T)_D$ | memory address | $R(T)_D$ |
|---|---|---|---|---|
| 1st hour | X 01 | 0 | Y 01 | 0 |
| 2nd hour | X 02 | 0 | Y 02 | 0 |
| 3rd hour | X 03 | 0 | Y 03 | 0 |
| 4th hour | X 04 | 0 | Y 04 | 0 |
| 5th hour | X 05 | 0 | Y 05 | 0 |
| 6th hour | X 06 | 2 | Y 06 | 1 |
| 7th hour | X 07 | 3 | Y 07 | 8 |
| 8th hour | X 08 | 4 | Y 08 | 4 |
| 9th hour | X 09 | 2 | Y 09 | 2 |
| 10th hour | X 10 | 0 | Y 10 | 1 |
| 11th hour | X 11 | 0 | Y 11 | 2 |
| 12th hour | X 12 | 4 | Y 12 | 0 |
| 13th hour | X 13 | 3 | Y 13 | 2 |
| 14th hour | X 14 | 2 | Y 14 | 3 |
| 15th hour | X 15 | 0 | Y 15 | 0 |
| 16th hour | X 16 | 0 | Y 16 | 0 |
| 17th hour | X 17 | 0 | Y 17 | 3 |
| 18th hour | X 18 | 2 | Y 18 | 1 |
| 19th hour | X 19 | 3 | Y 19 | 0 |
| 20th hour | X 20 | 5 | Y 20 | 2 |
| 21th hour | X 21 | 4 | Y 21 | 6 |
| 22th hour | X 22 | 3 | Y 22 | 2 |
| 23th hour | X 23 | 1 | Y 23 | 2 |
| 24th hour | X 24 | 0 | Y 24 | 1 |

METHOD OF LEARNING A REFRIGERATOR USE PATTERN FOR CONTROLLING A DEFROSTING OPERATION OF THE REFRIGERATOR

BACKGROUND OF THE INVENTION

1. Field of the Invention

The present invention relates to controlling a defrosting operation of a refrigerator, and more particularly to a method of learning a refrigerator use pattern so that the defrosting operation is carried out at a point of time when is not in use the refrigerator.

2. Description of the Prior Art

Generally, refrigerators perform freezing and refrigerating operations by driving compressors for a predetermined period and then defrosting operations for defrosting freezing chambers by actuating defrosting heaters. The defrosting period for such defrosting operations is controlled, depending on the freezing period and the refrigerating chamber temperature.

FIG. 1 is a block diagram of an operation control apparatus for a general refrigerator. As shown in FIG. 1, the operation control apparatus comprises an electric power supply unit 1 for supplying electric power to required units of the operation control apparatus, a compressor driving unit 3 for driving a compressor (not shown) for generating cold air, a cooling fan driving unit 4 for driving a cooling fan (not shown) for blowing the cold air into a freezing chamber and a refrigerating chamber of the refrigerator, a damper driving unit 6 for driving a damper (not shown) for opening and closing a passage of the cold air introduced in the freezing and refrigerating chambers, a heater driving unit 6 for driving a defrosting heater (not shown) for generating heat and thus defrosting the freezing chamber, a temperature sensing unit 7 for sensing temperatures of the freezing and refrigerating chambers by means of temperature sensors disposed in the freezing and refrigerating chambers, and a door opening/closing sensing unit 8 for sensing the opening and closing of the freezing and refrigerating chambers. The operation control apparatus also comprises a central processing unit 2 for controlling the compressor driving unit 3, the cooling fan driving unit 4, the damper driving unit 5 and the heater driving unit 6, in response to sensing signals from the temperature sensing unit 7 and door opening/closing sensing unit 8, and thus controlling the operation of the refrigerator.

Now, a conventional method for controlling a defrosting operation of the refrigerator with the above-mentioned operation control apparatus will be described, in conjunction with FIG. 2.

FIG. 2 is a flowchart of a procedure for controlling the operation of refrigerant in accordance with the prior art.

As shown in FIG. 2, electric power is applied to the refrigerator, the central processing unit 2 drives the compressor driving unit 3 and the cooling fan driving unit 4, so as to drive the compressor and the cooling fan. The central processing unit open damper by driving the damper driving unit 5 so that a cooling operation step for introducing cold air in the chambers of the refrigerator is carried out.

Thereafter, the central processing unit 2 counts the driving period of the compressor, that is, the cooling operation period and performs a step of determining whether the counted period corresponds to a predetermined period. Generally, a defrosting operation is carried out to defrost the freezing chamber, after a predetermined cooling operation period during which the compressor of refrigerator is driven lapses. The predetermined cooling operation period corresponds to a predetermined period for determining whether the sum of the periods during which the compressor is driven corresponds to a period after which a defrosting operation should be initiated.

If the counted period does not reach the predetermined period after which the defrosting operation is initiated, the central processing unit 2 then determines whether the chamber temperature sensed by the temperature sensing unit 7 reaches a predetermined minimum temperature. When the chamber temperature does not reach the predetermined minimum temperature, the central processing unit 2 performs a step of returning the procedure to the step of counting the compressor driving period.

When the chamber temperature has reached the predetermined minimum temperature as it is continuously lowered by the continued driving of the compressor, the counting of the compressor driving period is stopped, while keeping the counted value indicative of the period during which the compressor is driven. Simultaneously, the central processing unit 2 carrier out a step of turning off the compressor and the cooling fan and closing the damper.

After the compressor and the cooling fan are turned off, the central processing unit 2 determines whether the chamber temperature of the refrigerator has reached a predetermined maximum temperature. If the chamber temperature has reached the predetermined maximum temperature, the compressor and the cooling fan are turned on again and the procedure is returned to the step of carrying out the cooling operation. When the the compressor and the cooling fan are not driven, the chamber temperature increases, since the door of the refrigerator is often opened or the chambers of refrigerator is maintained at an imperfect thermal insulation state, even though the door is closed. Accordingly, the cooling operation is automatically initiated again in a manner as mentioned above, when the chamber temperature of refrigerator increases to the predetermined maximum temperature.

If the counted period indicative of the compressor driving period reaches the predetermined period, the counting of the compressor driving period is then initialized. At the same time, the central processing unit 2 turns off the compressor and the cooling fan and closes the damper. The central processing unit also turns on the defrosting heater by driving the heater driving unit 6, so as to perform the defrosting operation.

If a determination is made that the defrosting has been completed after the defrosting operation for a predetermined period, the central processing unit 2 then turns off the defrosting heater and returns to the cooling operation step.

Generally, the control of the chamber temperature of refrigerator is carried out in such a manner that when a predetermined chamber temperature is set to a desired temperature by the user, a predetermined maximum temperature and a predetermined minimum temperature which are obtained by adding positive and negative temperature tolerances to the predetermined chamber temperature, respectively, are stored in the central processing unit, as shown in FIG. 3. When the chamber temperature of the refrigerator is sensed as having been increased up to the predetermined maximum temperature, the central processing unit turns on the compressor, so as to achieve the cooling operation. As the chamber temperature is decreased to the predetermined minimum temperature, by the cooling operation, the central processing unit turns off the compressor, so as to stop the cooling operation. That is, the central processing unit controls the operation of refrigerator by repeating the operations of turning on/off the compressor.

As apparent from the above description, the temperature control is achieved by turning on/off the compressor and the cooling fan so that the chamber temperature of refrigerator and maintained between the predetermined maximum temperature and the predetermined minimum temperature. On the other hand, the defrosting operation is achieved by counting the periods during which the compressor is maintained at its ON state, summing the periods and driving the defrosting heater for a predetermined driving period when the summed time corresponds to a predetermined time.

However, such a control for the defrosting operation has a disadvantage that the defrosting operation is carried out irrespective of whether the refrigerator is being used by the user, since the point of time when the defrosting operation should be initiated is simply determined by the time obtained only by summing the periods during which the compressor is maintained at its ON state.

Assuming that the periods that the user frequently uses the refrigerator, that is, frequently opens the door of refrigerator are the period T1 from 6:00 to 9:00, the period T2 from 11:00 to 13:00 and the period T3 from 17:00 to 20:00 and that the defrosting operation initiating time point based on the sum of the compressor driving periods is the time point t1, the compressor is controlled to be forcibly turned off at the time point t1, as shown in FIG. 3. The defrosting heater is turned on at the time point t1, to initiate the defrosting operation.

Since the chamber temperature increases as the defrosting operation is carried out, the chamber temperature exceeds the predetermined maximum temperature beginning at timepoint t2. Furthermore, when the door of refrigerator is opened by the user during the defrosting operation, the chamber temperature increases sharply to a level at which a desired refrigerating temperature can not be obtained, since the period that the defrosting operation is carried out is included in the period T2 which is one of the periods that the user frequently uses the refrigerator. The chamber temperature can be decreased to the predetermined maximum temperature satisfying the desired refrigerating temperature only at the time point t3 corresponding to a certain time after the period T4 passe, that is, after the defrosting operation was completed and the compressor was driven.

Actually, the increase in chamber temperature during the defrosting operation is higher than the natural increase in chamber temperature, due to the operation of defrosting heater. That is, when the defrosting operation is carried out during the period that the user frequently uses the refrigerator, the chamber temperature is increased to a greatly higher temperature, as compared with the case that the door of the refrigerator is frequently opened under the condition that no defrosting operation is carried out. This is because the temperature increase caused by the defrosting operation is added to the temperature increase caused by the refrigerator door opening. As a result, the chamber temperature is excessively increased and can not be decreased to the predetermined maximum temperature or below while the defrosting operation is continued. Consequently, there is a problem that the chamber temperature can not be maintained at the predetermined temperature desired by the user.

SUMMARY OF THE INVENTION

Therefore, an object of the invention is to solve the above-mentioned problem encountered in the prior art and to provide a method for controlling the defrosting operation of a refrigerator by automatically learning the using pattern of the refrigerator so that the defrosting operation is carried out during a period that the user does not use the refrigerator.

In accordance with the present invention, this object can be accomplished by providing a method of learning a using pattern for controlling a defrosting operation of a refrigerator, comprising the steps of: (a) dividing a day into a plurality of time intervals and counting the number of door opening times by time intervals; (b) calculating an arithmetic average value of the number of door opening times for each time interval; (c) repeating the steps (b) and (c) for predetermined days, to calculate arithmetic average values of the number of door opening times by time intervals for the predetermined days and storing data about the calculated arithmetic average values in a memory; and (d) carrying out the defrosting operation in a period that the refrigerator is not used, based on the stored data.

In accordance with the present invention, the refrigerator using pattern by the user is analyzed using a learning equation, a learning algorithm and a memory mapping so that the defrosting operation is carried out at the period that the refrigerator is not used by the user.

The refrigerator using pattern learning also follows a variation in refrigerator using pattern and the defrosting operation is carried out at the period that the refrigerator is not used by the user, based on the resultant learning.

Using an external memory unit, the refrigerator using pattern is periodally stored so that it can be still kept in memory, even when electric power is shut off.

In accordance with the method of the present invention, the defrosting operation can be controlled to be performed when the refrigerator is not used. Accordingly, the defrosting operation period does not overlap with the period that the door of the refrigerator is frequently opened. Therefore, the present invention solves the problem that the chamber temperature can not be maintained at a desired temperature, due to the overlap between the defrosting operation period and the refrigerator using period.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
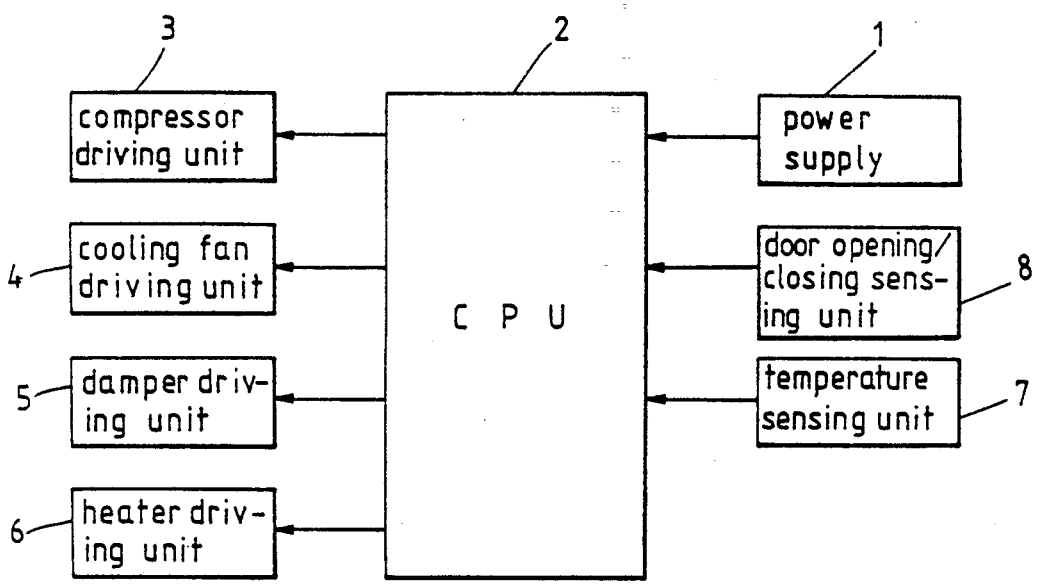
FIG. 1 PRIOR ART
FIG. 1 is a block diagram of an operation control apparatus for a general refrigerator.
Figure 2:
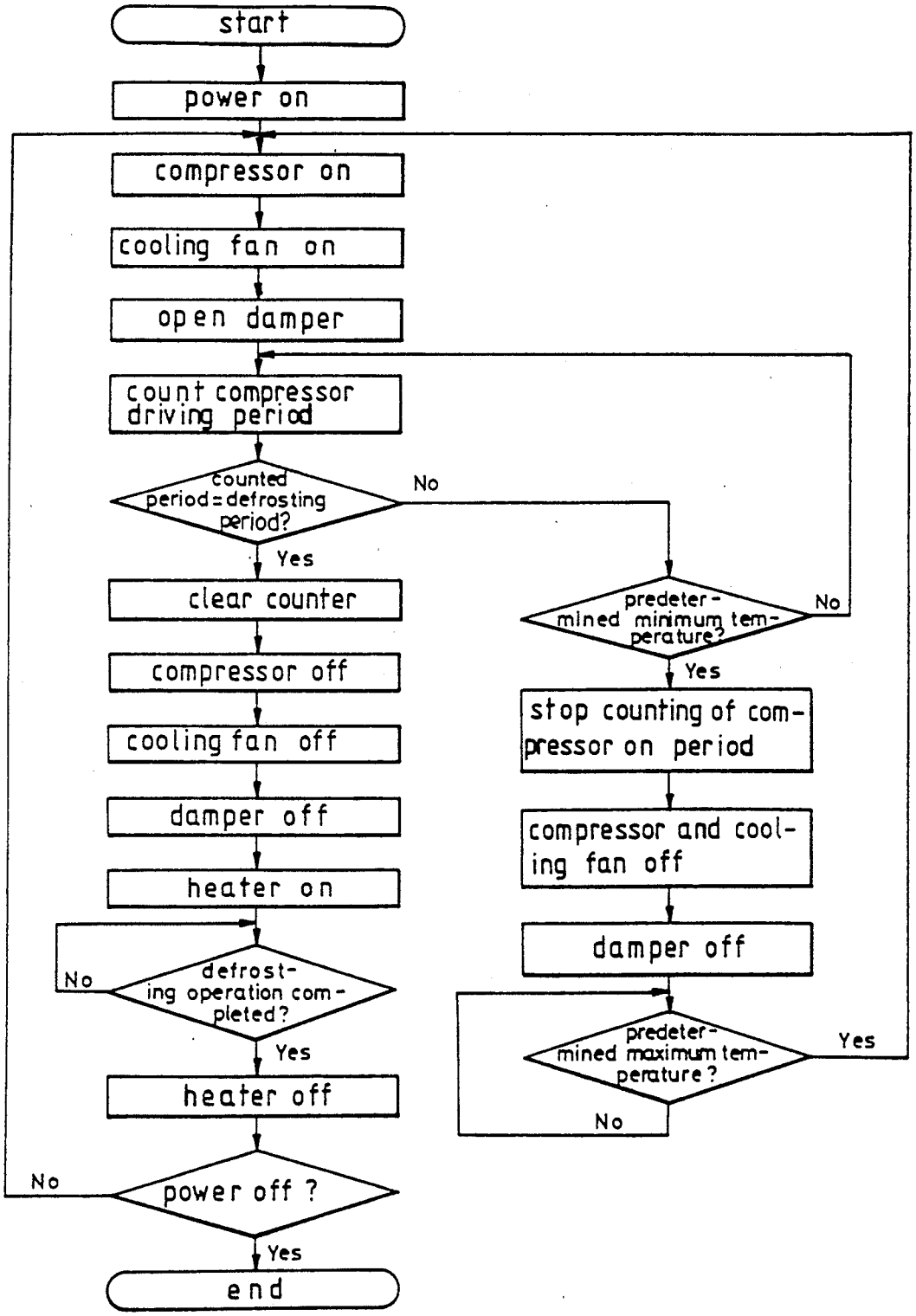
FIG. 2 PRIOR ART
FIG. 2 is a flowchart of a procedure for controlling the operation of refrigerator in accordance with the prior art.
Figure 3:
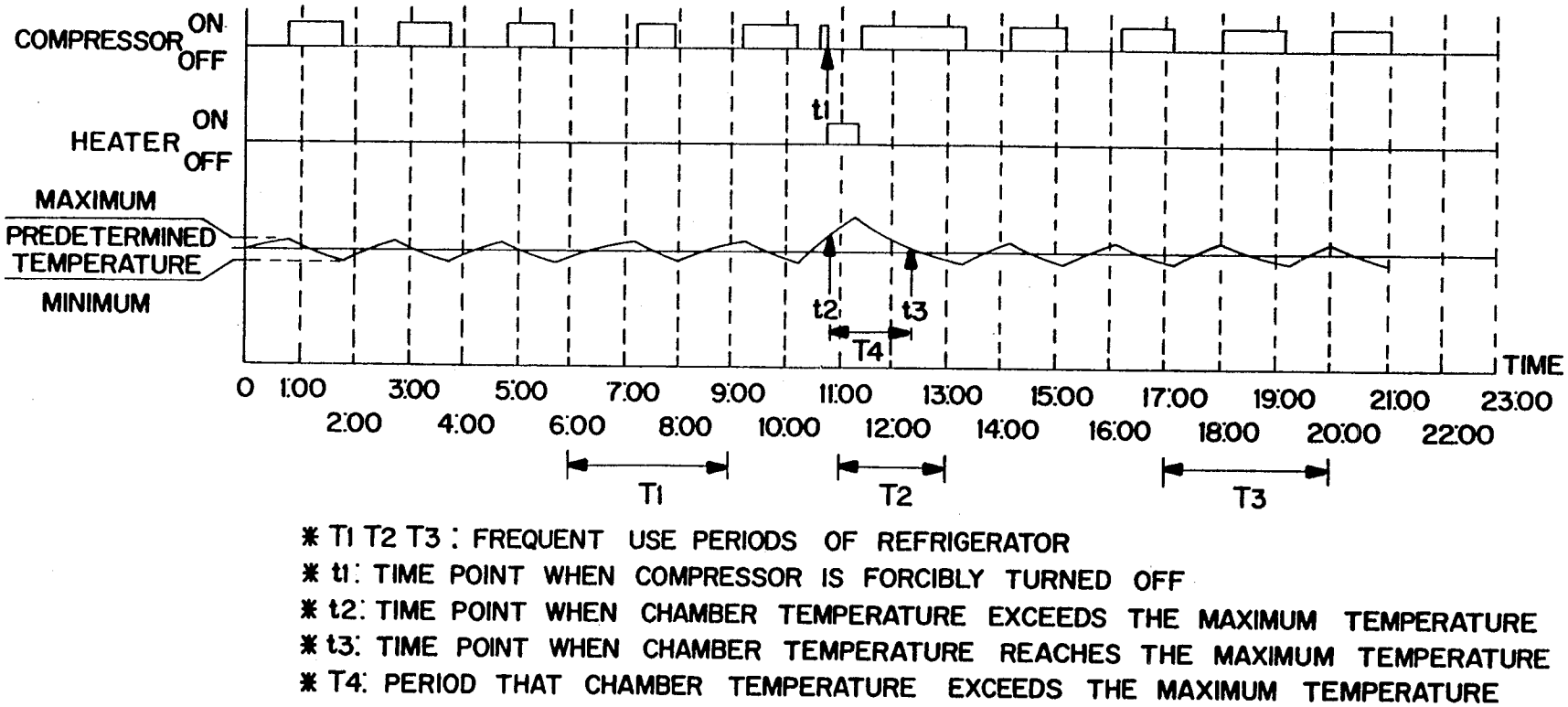
FIG. 3 PRIOR ART
FIG. 3 is a timing diagram illustrating the control procedure of cooling and defrosting operations of refrigerator in accordance with the prior art.
Figure 4:
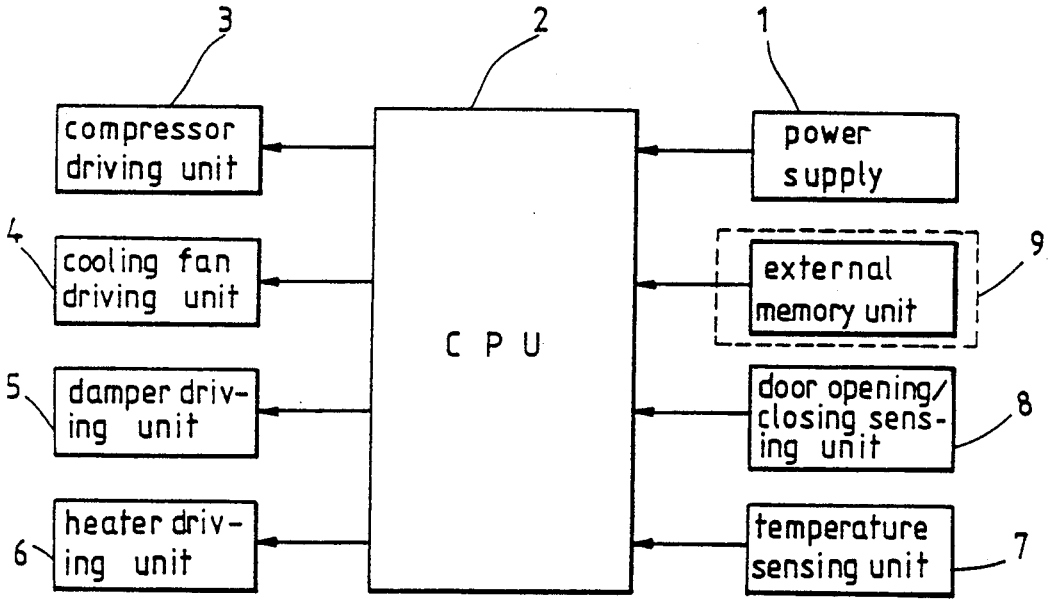
FIG. 4 is a block diagram of an operation control apparatus for a refrigerator in accordance with the present invention.

Referring to FIG. 4, there is illustrated a block diagram of an operation control apparatus for a refrigerator in accordance with the present invention. In FIG. 4, the same elements as in FIG. 1 are denoted by the same reference numerals.

As shown in FIG. 4, the operation control apparatus of the present invention comprises an electric power supply unit 1 for supplying electric power from an external electric power source (not shown) to required units of the operation control apparatus, a compressor driving unit 3 for driving a compressor (not shown) for generating cold air, a cooling fan driving unit 4 for driving a cooling fan (not shown) for blowing the cold air into a freezing chamber and a refrigerating chamber of the refrigerator, a damper driving unit 5 for driving a damper (not shown) for opening and closing a passage of the cold air introduced in the freezing and refrigerating chambers, a heater driving unit 6 for driving a defrosting heater (not shown) for generating heat and thus defrosting the freezing chamber, a temperature sensing unit 7 for sensing temperatures of the freezing and refrigerating chambers by means of temperature sensors disposed in the freezing and refrigerating chambers, and a door opening/closing sensing unit 8 for sensing the opening and closing of the freezing and refrigerating chambers. The operation control apparatus also comprises an external memory unit 9 for storing information about the using pattern of refrigerator for controlling a defrosting operation and a central processing unit 2 for controlling the compressor driving unit 3, the cooling fan driving unit 4, the damper driving unit 5 and the heater driving unit 6, in response to sensing signals from the temperature sensing unit 7 and door opening/closing sensing unit 8 and the refrigerator using pattern information stored in the external memory unit 9, and thus controlling the operation of the refrigerator.

That is, the operation control apparatus of the present invention has an arrangement added with the external memory unit 9 for storing the refrigerator using pattern information, as compared with the conventional apparatus.

The central processing unit 2 of the operation control apparatus controls the compressor driving unit 3, the cooling fan driving unit 4 and the damper driving unit 5, so as to control both the turning on/off of the compressor and cooling fan and the opening/closing of the damper. By this control of the central processing unit 2, a cooling operation is carried out. During the cooling operation, the central processing unit 2 controls continuously the driving of the compressor, cooling fan, and damper so that the chamber temperature in the refrigerating chamber or the freezing chamber sensed by the temperature sensing unit 7 is maintained between predetermined maximum and minimum temperatures defined based on a predetermined temperature set by the user. The definition of these predetermined maximum and minimum temperatures is accomplished in a conventional manner as mentioned above.

In accordance with the present invention, the central processing unit 2 counts the number of door opening times sensed by the door opening/closing sensing unit 8, by time intervals and calculates arithmetic average values of the door opening number by time intervals, so as to determine the refrigerator using pattern by the user. It also serves to store the refrigerator using pattern in the external memory unit 9 and carry out the defrosting operation during a period that the user does not use the refrigerator, based on the refrigerator using pattern.

That is, the present invention accomplishes controlling of the defrosting operation by providing a defrosting operation control method wherein the refrigerator using pattern by the user is learned. This defrosting operation control method based on the learning of the refrigerator using pattern comprises the steps of dividing a day, namely, 24 hours into a plurality of time intervals each corresponding to a predetermined period, for example, one hour, calculating the number of refrigerator door opening times by time intervals, repeating the calculating step for predetermined days, storing information about arithmetic average values of the door opening number calculated by time intervals, and performing a defrosting operation during a period corresponding to a time interval that the refrigerator is not used by the user, based on the arithmetic average value information.

In accordance with the defrosting operation control method, the overall steps as mentioned above are also periodically repeated after the lapse of predetermined days so that a variation in refrigerator using pattern by the user can be learned, so as to achieve controlling of the defrosting operation based on the variation.

The learning of the refrigerator using pattern by the user is achieved by arithmetically averaging data about the number of door opening times at a predetermined time interval. This procedure will be now described.

For example, assuming that the number of times checking the number of door opening times at an optional time interval in every day is five and that data about the number of door opening times are 2, 4, 6, 4 and 2, respectively, the arithmetic average value can be calculated as follows:

$$\frac{2+4+6+4+2}{5} = 3 + \frac{3}{5}$$

The arithmetic average value of the number of door opening times can be also calculated, based on the number of times checking the number of door opening times, as follows:

$$\frac{\left[\frac{\left[\frac{\left[\frac{2}{1}\right] * 1 + 4}{2}\right] * 2 + 6}{3}\right] * 3 + 4}{4}\Bigg] * 4 + 2}{5} = 3 + \frac{3}{5}$$

If the arithmetic average value is not expressed by a decimal, but a quotient and the balance, it can be expressed as follows:

$$3 + \frac{3}{5} = 3_5 + [3]_5 \rightarrow M_k + R_k$$

From the above equation, the following equation can be derived for K that obtained at the number of times K of checking the number of door opening times at an optional time interval in every day:

$$\frac{\left[\frac{\left[\frac{\left[\frac{N_1}{1}\right] * 1 + N_2}{2}\right] * 2 + N_3}{3}\right] * 3 + N_4}{4}$$

$$\vdots$$

$$\frac{M_{K-1} * (K-1) + R_{K-1} + N_K}{K} = M_k + R_K$$

where

K: a variable indicative of the number of times periodically checking the number of door opening times at an optional time interval in every checking period, that is, the number of days when the checking period is a day;

$M_K$: a quotient derived from the equation;

$R_K$: the balance; and

N: the number of door opening at times at each checking period.

The information $M_K$ and $R_K$ about the current arithmetic average value is derived by an operation procedure based on an operation equation including $M_{K-1}$ and $R_{K-1}$ which are information about the arithmetic average value just before the current arithmetic average value. That is, the information $M_K$ and $R_K$ about the current arithmetic average value is derived by adding new data $N_K$ to the information $M_{K-1}$ and $R_{K-1}$. Accordingly, the learning of the refrigerator using pattern by the user can be achieved, based on the arithmetic average value about the number of door opening times at a predetermined time interval in every checking period.

Where data for respective variables K of 1 to D are input, the arithmetic average value, namely, the learned result at the variable K of D can be expressed as follows:

$$M_D + R_D = \left[\frac{M_{K-1} * (K-1) + R_{K-1} N_K}{K}\right]_{K=1}^{D}$$

$$= \left[M_{K-1} + \frac{R_{K-1} + N_K - M_{K-1}}{K}\right]_{K=1}^{D}$$

For example, if the number of door opening times at a predetermined time interval is 2, when it is checked only for the first checking period, that is, the first day and if all initial values are zero, D is 1 and $N_1$ is 2. Accordingly, the values of $M_1=2$ and $R_1=0$ can be derived by the following equation:

$$M_1 + R_2 = \left[0 + \frac{0+2-2}{1}\right]_{K=1}^{D} = 2 + [0]$$

From the derived values, it can be found that when the number of door opening times at a predetermined time interval only in one day is checked, the door opening is detected two times and the quotient and the balance of the arithmetic average value are 2 and 0, respectively.

If the number of door opening times is checked for three days at the checking period of a day and the data indicative of the number of door opening times detected for three days at a predetermined time interval in every checking period are 2, 3 and 3, respectively, that is, if D is 3 and the inputted data $N_1$, $N_2$ and $N_3$ are 2, 3 and 2, respectively, the arithmetic average value for each checking period can be derived as follows:

where $K$ is 1, $M_1 + R_2 =$ $$\left[M_0 + \frac{R_0 + N_1 - M_0}{1}\right]_{K=1}^{K=1} = \left[0 + \frac{0+2-0}{1}\right] = 2 + [0]$$

where $K$ is 2, $M_2 + R_2 =$ $$\left[M_0 + \frac{R_1 + N_2 - M_1}{2}\right]_{K=1}^{K=2} = \left[0 + \frac{0+3-2}{2}\right] = 2 + [1]$$

where $K$ is 3, $M_3 + R_3 =$ $$\left[M_2 + \frac{R_2 + N_3 - M_2}{1}\right]_{K=1}^{K=3} = \left[2 + \frac{1+2-2}{3}\right] = 2 + [1]$$

As is apparent from the above equations, the arithmetic average value is newly derived, based on new data. Accordingly, it can be derived in the same manner, at every time when all data is input.

When the above-mentioned equation for deriving the arithmetic average values is modified to match with various variables including the number of door opening times, the number of days and the time interval number, the following arithmetic average equation can be obtained for data indicative of the number of days D, the time interval number T and the number of door opening times N:

$M(T)_D + R(T)_D =$ $$\left[\left[M(t)_{K-1} + \frac{R(t)_{K-1} + N(t)_K - M(t)_{K-1}}{K}\right]_{K=1}^{K=D}\right]_{t=1}^{T}$$

where, $M(T)_D$: the quotient of the arithmetic average value for the number of door opening times at a time interval t for D days;

$R(T)_D$: the balance of the arithmetic average value for the number of door opening times at the time interval t for D days; and $N(t)_K$: the number of door opening times at the time interval t in the Kth day.

Figure 5:
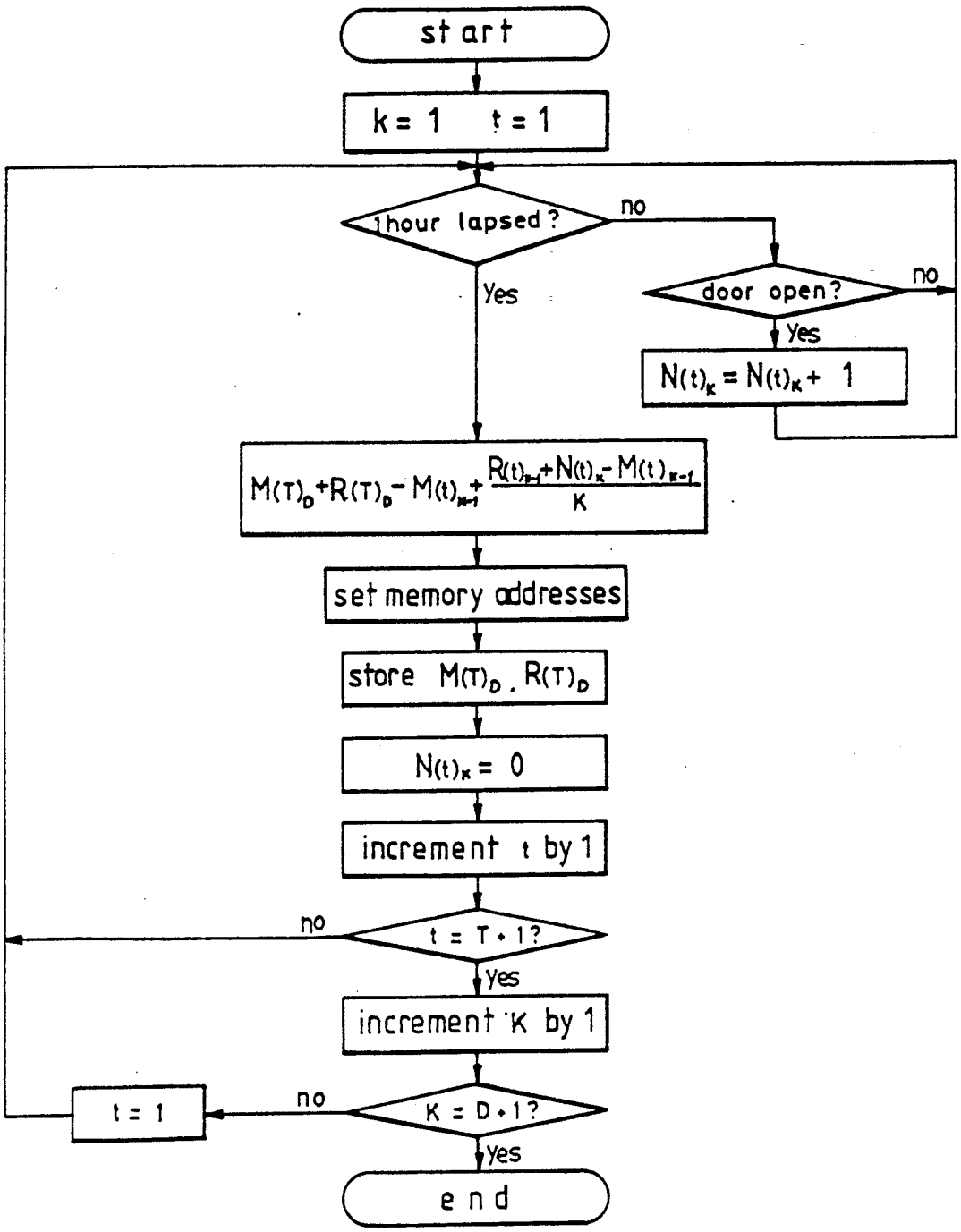
FIG. 5 is a flowchart of a procedure for controlling the defrosting operation of refrigerator, based on a refrigerator using pattern learning method in accordance with the present invention.

Now, an algorithm for learning the refrigerator using pattern for D days using equation (1) will be described, in conjunction with FIG. 5. In this case, each day is divided into 24 time intervals. That is, T is 24.

First, the variable K for the number of days is initialized to be 1 (K=1). For counting the lapse of time intervals in every day, the variable t is also initialized to be 1 (t=1). Thereafter, a step of accumulating the number of door opening times until one time interval, namely, one hour lapses is carried out $[N(t)_K=N(t)_K+1]$.

When one hour has lapsed, the arithmetic average value for the number of door opening times at the present time interval is calculated, based on equation (1). Thereafter, memory addresses corresponding to the present time interval are set. Subsequently, a step of storing the quotient and the balance of the calculated arithmetic average value in the memory locations corresponding to the memory addresses is carried ut.

The variable $N(t)_K$ indicative of the number of door opening times is then initialized ($N(t)_K=0$), so as to count the number of door opening times at the next time interval. Then, the variable t indicative of the number of the time intervals at which the number of door opening times was already counted or is currently counted is incremented by 1. Next, a determination is made whether the variable t corresponds to the value obtained by adding 1 to the total number of time intervals T (t=T+1). That is, a step of checking whether the arithmetic average values for all time intervals, namely, 24 hours are calculated is carried out.

If the variable t does not correspond to the value obtained by adding 1 to the total number of time intervals T, that is, when 24 hours does not lapse, the step of calculating the arithmetic average value for the number of door opening times is carried out again for the next time interval. The above-mentioned steps are repeated until 24 hours lapses, so that the arithmetic average values for all time intervals are calculated.

If the variable t corresponds to the value obtained by adding 1 to the total number of time intervals T (t=T+1), that is, when 24 hours has lapsed, a step of incrementing the variable K indicative of the number of days by 1 is carried out. Thereafter, a determination is made about whether the variable K indicative of the number of days corresponds to the value obtained by adding 1 to the number of days D (K=D+1).

If the variable K does not correspond to the value obtained by adding 1 to the number of days D, the variable t indicative of the number of checked time intervals is initialized. Thereafter, the procedure is returned to the step of accumulating the number of door opening times. If the variable K corresponds to the obtained value, the refrigerator using pattern learning procedure is ended.

As apparent from the above description, the refrigerator using pattern is learned by calculating the arithmetic average values according to the accumulation of the number of door opening times by time intervals, storing the quotient and the balance of each calculated arithmetic average value, and repeating the above steps are predetermined days.

Figure 6:
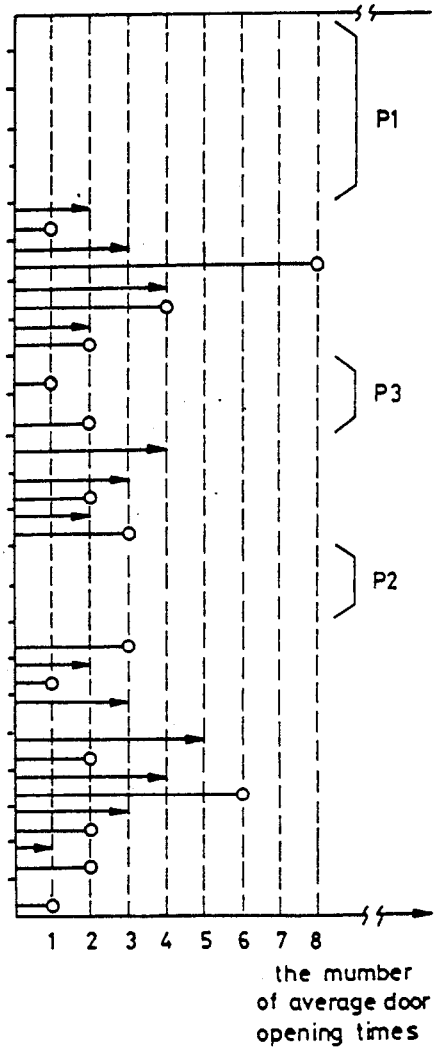
FIG. 6 is a schematic view illustrating data stored in a memory and a refrigerator using pattern obtained by the control procedure shown in FIG. 5.

Referring to FIG. 6, there is illustrated an example of data about the quotient and the balance of each calculated arithmetic average value for the refrigerator using pattern.

As shown in FIG. 6, a day is divided into 24 time intervals, that is, 24 hours, to obtain the 1st hour, the 2nd hour, the 3rd hour, the 4th hour . . . , and the 24th hour. That is the variable T includes 1 to 24. On the other hand, the quotients $M(T)_D$ of arithmetic average values calculated for respective time intervals are stored in memory locations corresponding to memory addresses $X_{01}$, $X_{02}$, $X_{03}$, $X_{04}$, . . . , and $X_{24}$, respectively. Also, the balances $M(T)_D$ of arithmetic average values calculated for respective time intervals are stored in memory locations corresponding to memory addresses $Y_{01}$, $Y_{02}$, $Y_{03}$, $Y_{04}$, . . . , and $Y_{24}$, respectively. Referring to FIG. 6, it can be found that the time intervals from 1st hour to the 5th hour and the time intervals of the 15th hour and the 16th hours are the period P1 that the refrigerator is not used by the user, whereas the time intervals from the 6th hour to the 9th hour and the time intervals from the 17th hour to the 24th hour are the period P2 that the refrigerator is frequently used by the user. Although including no the quotient of the arithmetic average value, the time intervals of the 10th hour and the 11th hour are the period P3 that the refrigerator has more or less a probability of being used by the user.

From the information about the time intervals corresponding to the period P1 that the refrigerator is not used by the user as shown in FIG. 6, the period that the defrosting operation can be optimally achieved can be found. Accordingly, the defrosting operation can be optimally carried out by finding the period P1 that the refrigerator is not used by the user, that is, the period having a minimum probability of using the refrigerator by the user.

Such a refrigerator using patterning learning is continued for predetermined days for one time learning. This learning is also periodically carried out every month or every season so that it follows a possible monthly or seasonal variation in refrigerating using pattern. Information about the refrigerator using pattern is also stored in the external memory unit so that it can be still kept in memory, even when electric power is shut off.

As apparent from the above description, the present invention provides an algorithm required for learning and recognizing the refrigerator using pattern by detecting the using condition of refrigerator based on the opening and closing of the refrigerator door, counting the number of refrigerator using times by time intervals and calculating the number of average using times by time intervals, so as to achieve a defrosting operation at the period that the refrigerator is not used by the user.

What is claimed is:

1. A method of learning a use pattern for controlling a defrosting operation of a refrigerator, comprising the steps of:

(a) dividing a day into a plurality of time intervals and counting a number of door openings for each of the plurality of time intervals;

(b) calculating an arithmetic average value of the number of door opening times for each of the plurality of time intervals;

(c) repeating steps (b) and (c) for predetermined days, to calculate the arithmetic average values of the number of door opening times for each of the plurality of time intervals for the predetermined days and storing the calculated arithmetic average values for the predetermined days in a memory; and (d) performing a defrosting operation in ones of the plurality of time intervals when a door of the refrigerator is not opened, based on the stored calculated arithmetic averages.

2. The method of claim 1, wherein the calculation in the steps (b) and (c) satisfies the following arithmetic average equation:

$$M(T)_D + R(T)_D = \left[\left[M(t)_{K-1} + \frac{R(t)_{K-1} + N(t)_K - M(t)_{K-1}}{K}\right]_{K=1}^{X=D}\right]_{t=1}^{T}$$

where,

D: the number of days;

K: a variable of the number of days D;

N: the number of door openings in a time interval;

T: the number of time intervals in a day;

t: a variable of the number of time intervals T;

$M(T)_D$: the quotient of the arithmetic average value for the number of door openings at a time interval t for D days;

$R(T)_D$: the balance of the arithmetic average value for the number of door openings at the time interval t for D days; and $N(T)_X$: the number of door openings at the time interval t in the Kth day.

3. A refrigerator system comprising:

defrosting means for defrosting said refrigerator system;

door opening/closing sensing means for determining a number of openings/closings of a door of said refrigerator system for a plurality of time intervals;

central processing means for receiving the number of openings/closings for the plurality of time intervals and for controlling said defrosting means such that said defrosting means defrosts said refrigerator system in one of the plurality of time intervals where the number of openings/closings is zero.

4. The refrigerator system of claim 3, said refrigerator system further comprising:

compressor means for cooling said refrigerator system; and temperature sensing means for sensing a temperature of said refrigerator system;

said central processing means further setting an upper and lower limit for the sensed temperature and controlling said compressor means and said defrosting means such that the sensed temperature is maintained within the upper and lower limit.

5. The refrigerator system of claim 3, wherein said central processing means generates a refrigerator use pattern from the number of openings/closings for the plurality of time intervals.

6. The refrigerator system of claim 5, wherein said central processing means generates the refrigerator use pattern by calculating an arithmetic average value for the plurality of time intervals.

7. The refrigerator system of claim 6, wherein the arithmetic average value is calculated as follows:

$$M(T)_D + R(T)_D = \left[\left[M(t)_{K-1} + \frac{R(t)_{K-1} + N(t)_K - M(t)_{K-1}}{K}\right]_{K=1}^{X=D}\right]_{t=1}^{T}$$

where,

D: the number of days;

K: a variable of the number of days D;

N: the number of door openings in a time interval;

T: the number of time intervals in a day;

t: a variable of the number of time intervals T;

$M(T)_D$: the quotient of the arithmetic average value for the number of door openings at a time interval t for D days;

$R(T)_D$: the balance of the arithmetic average value for the number of door openings at the time interval t for D days; and $N(T)_X$: the number of door openings at the time interval t in the Kth day.

8. The refrigerator system of claim 3, wherein each of the plurality of time intervals is one hour.

9. The refrigerator system of claim 5, wherein the refrigerator use pattern is a daily use pattern.

10. The refrigerator system of claim 5, wherein the refrigerator use pattern is a weekly use pattern.

11. The refrigerator system of claim 5, wherein the refrigerator use pattern is a monthly use pattern.

12. The refrigerator system of claim 5, wherein the refrigerator use pattern is a seasonal use pattern.

* * * * *